US005254525A

United States Patent [19]

Nakajima et al.

[11] Patent Number: 5,254,525

[45] Date of Patent: Oct. 19, 1993

[54] THERMAL TRANSFER IMAGE RECORDING MATERIAL AND METHOD OF ITS PRODUCTION

[75] Inventors: Atsushi Nakajima; Tomonori Kawamura; Shigehiro Kitamura; Kunihiro Koshizuka, all of Hino, Japan

[73] Assignee: Konica Corporation, Tokyo, Japan

[21] Appl. No.: 838,501

[22] Filed: Feb. 19, 1992

[30] Foreign Application Priority Data

Feb. 21, 1991 [JP] Japan ..... 3-27592

[51] Int. Cl.[5] ..... B41M 5/035; B41M 5/38

[52] U.S. Cl. ..... 503/227; 428/195; 428/204; 428/913; 428/914

[58] Field of Search ..... 8/471; 428/195, 204, 428/207, 913, 914; 503/227

[56] References Cited

PUBLICATIONS

Database WPIL, No. 90-221734, Derwent Publications Ltd., London, GB; & JP-A-2151484 (Nitto Denko) Nov. 6, 1990 *The entire abstract*.

*Primary Examiner*—B. Hamilton Hess

*Attorney, Agent, or Firm*—Frishauf, Holtz, Goodman & Woodward

[57] ABSTRACT

Thermal transfer image recording material and a method of its production for an ID card which bears a distinct gradation image with high durabilty without using a laminate film, is disclosed. It is coated with a UV-setting resin and has a UV absorbing layer underneath for protecting the image from discoloring by UV irradiation.

6 Claims, 3 Drawing Sheets

THERMAL TRANSFER IMAGE RECORDING MATERIAL AND METHOD OF ITS PRODUCTION

FIELD OF THE INVENTION

The present invention relates to an image-bearing image-receiving sheet for thermal transfer recording and a method of its production, specifically an image-bearing image-receiving sheet for thermal transfer recording which offers improved image preservability, prevents the falsification of the image or thermal transfer recording medium itself and offers improved durability for the thermal transfer recording medium, and an efficient method of its production.

More specifically, the invention relates to a card-sized image-recording material which bears a distinct gradation image with high durability without using a laminate film and which is not forgeable or alterable, and a method of rapidly producing such an excellent card-sized image-recording material which is free of image damage by sublimation dyes even in UV irradiation during the production process and produces no cutting dust as with the use of a laminate film.

BACKGROUND OF THE INVENTION

Traditionally, there have been investigations of color recording methods for color hard copies based on ink jet, electrophotography and thermal transfer recording, for instance.

Among these methods, thermal transfer recording has some advantages, including easy operation and maintenance and permission of equipment size reduction and cost reduction. There are two modes of this thermal transfer recording method.

In one method, a transfer sheet having a melting ink layer on the support is imagewise heated by a laser beam or thermal head to melt-transfer the melting ink layer onto an image-receiving sheet for thermal transfer recording. In the other method, the heat diffusion transfer method, an ink sheet for thermal transfer recording having on the support an ink layer containing a heat diffusible dye (sublimation dye) is used to diffuse and transfer the heat diffusible dye onto an image-receiving sheet for thermal transfer recording.

The heat diffusion transfer method has recently drawn much attention as yielding color images with continuously changing color density by superpose recording of cyan, magenta and yellow colors, since it permits image gradation control by changing the amount of dyes transferred according to thermal energy change in the thermal head.

However, the conventional heat diffusion transfer method has a drawback of essentially poor image preservability. In comparison with the recording images obtained by ordinary silver salt photographic methods, the storage period is shorter, which hampers the practical application of this method to personal identifying photographs and other fields where high image preservability is essential.

The present invention has been made to solve the problems described above. Accordingly, the present invention relates to a thermal transfer image-recording material which offers improved image preservability, prevents the falsification of the image or the thermal transfer image-recording material itself and offers improved durability of the thermal transfer image-recording material, and a method of its production.

Developed with the aim of accomplishing this object, the present invention provides a thermal transfer image-recording material comprising an image-bearing image-receiving layer, a UV-absorbing resin layer and a UV-setting resin layer, all of which are formed on the support in this order, and a method of producing a thermal transfer image-recording material wherein the image-receiving layer of an image-receiving sheet for thermal transfer recording, composed of the support and the image-receiving layer, and the ink layer, containing a heat diffusible dye, of an ink sheet for thermal transfer recording are superposed and imagewise heated to transfer an image to the image-receiving layer, this image formation surface is covered with a UV-absorbing resin layer and then covered with a UV-setting resin layer, which layer is then set by UV irradiation.

Traditionally, a wide variety of ID cards have been used, including identification certificates, driving licenses and membership certificates. The ID card usually bears a personal figure image for identification of the card owner and various pieces of other information. The personal figure image can be prepared as a gradation-information-bearing image because it usually has varied density. The various pieces of other information include the address, name, date of birth and position of the card owner and the validation date of the card in the case of personal identification certificates, and the date of birth, name, license number of the card owner and the license category in the case of driving licenses. These pieces of information, written in characters, numerical figures, symbols, etc., can be prepared as a character-information-bearing image.

Currently there are two methods of forming a gradation-information-bearing image for ID cards, namely the sublimation transfer method and the silver halide photographic method. Irrespective of which method is used to form the gradation-information-bearing image, a key to ID cards is to perfectly prevent the forgery and alteration thereof. It is very evident why ID cards should not be forged or altered.

Traditionally, to prevent the forgery and alteration of ID cards, it has been recognized as effective to laminate the ID card with a transparent sheet (this method is also referred to as the laminate method for short) or to coat the ID card with a UV-setting resin and then irradiate ultraviolet rays to set the UV-setting resin to form a set film (this method is also referred to as the UV irradiation method for short).

However, even when the ID card having a gradation-information-bearing image formed on the image-receiving layer by sublimation thermal transfer is laminated with a transparent sheet, the image-receiving layer and the transparent sheet can easily be detached from each other, since the image-receiving layer itself is a thermoplastic resin sheet, for instance, and the transparent sheet is also a thermoplastic resin sheet. Therefore, transparent sheet lamination cannot perfectly prevent the forgery or alteration.

Also, the gradation-information-bearing image formed on the image-receiving layer by sublimation thermal transfer poses a problem of image damage by heating upon lamination of the transparent sheet on the ID card because this image is formed by a sublimation dye. In other words, in case of excessive heat being added, in order to obtain a sufficient adhesion, the gradation-information-bearing image formed on the image-receiving layer by sublimation thermal transfer has no endurance against the lamination treatment.

When laminating the ID card with a transparent sheet, the transparent sheet usually has an area larger than that of the ID card. Specifically, a transparent sheet having an area larger than that of the ID card is placed on the gradation-information-bearing image formation surface of the ID card, followed by heat treatment, after which the transparent sheet's portion sticking out from the ID card is cut out. Therefore, the ID card lamination method produces transparent sheet cutting dust; a problem of occurrence of much cutting dust is posed where a large number of ID cards are prepared.

When a protective layer is formed by UV irradiation on the surface of an ID card having a gradation-information-bearing image formed on the image-receiving layer by sublimation thermal transfer, coating a UV-setting resin on the gradation-information-bearing image surface results in blurs in the gradation-information-bearing image formed by sublimation dye, which poses a problem of loss of image distinctness. Since the ID card will not ensure the identification of the card owner, if the personal figure image, a gradation-information-bearing image, is blurred, this UV irradiation method is critically faulty so that it cannot be adopted for the preparation of ID cards.

On the other hand, with respect to the ID cards having a gradation-information-bearing image formed by the silver salt photographic method, there is no problem as with the ID cards having a gradation-information-bearing image formed by the sublimation thermal transfer method, it requires much time to prepare ID cards because it requires a large number of processes such as development, fixation and bleaching to form the gradation-information-bearing image. Therefore, the method of ID card preparation based on silver salt photography is not applicable at all where a large number of ID cards should be prepared rapidly.

The present invention has been developed in the circumstances described above. The object of the invention is to overcome the problems described above and provide a unforgeable, unalterable card-sized image-recording material having a distinct gradation-information-bearing image with high durability using no laminate films, and a method of rapidly producing such an excellent card-sized image-recording material wherein the image is not damaged by sublimation dye even in UV irradiation during the production process and no cutting dust is produced as with the use of laminate film.

With the aim of accomplishing the object described above, the present inventors made investigations focusing mainly on some points, which are described below with reference to an example of issuing ID cards such as driving license certificates.

The inventors first directed their attention to the fact that sublimation thermal transfer is very advantageous over silver salt photography in that it is much more rapid in smooth formation of a color photographic facial image. The inventors also directed their attention to the fact that operation and equipment can often be simplified with advantage by printing ID data and common data such as those in characters or codes by hot melt thermal transfer or sublimation thermal transfer.

In this case, however, the inventors considered that a satisfactory result can be obtained by printing the gradation-information-bearing image by sublimation thermal transfer while printing the image which should not necessarily be a gradation-information-bearing image by hot melt thermal transfer, and that these methods may be appropriately selected as the case may be.

In the case of images printed by sublimation thermal transfer (e.g., color photographic facial images), there is a problem of blurs and discoloration in the sublimation dye image due to heat upon lamination treatment when it is attempted to laminate the image in perfect adhesion with the laminate material to protect the image or the image recording material or to prevent the falsification of the image.

The inventors thus directed their attention from the lamination method to the traditional method in common use for silver salt photographic images, in which a protective film comprising a UV-setting resin film is formed on the image, to use it to provide protection and durability for the image or image-recording material. This protective film formation method can easily be achieved by coating a coating agent containing a UV-setting resin on the entire or desired partial surface of the image-recording material and setting the resin or monomer by UV irradiation, which method should ensure more rapid obtainment of the desired effects with no heating.

However, this method, in which a protective film comprising a UV-setting resin layer is formed, was found to pose other problems, such as sublimation dye blurs in the sublimation thermal transfer image by the resin, monomer or solvent during coating the coating agent, image damage during UV irradiation and inhibition of the setting of UV-setting resin by sublimation dye.

SUMMARY OF THE INVENTION

With the aim of solving these problems, the present inventors made further investigations. Specifically, an appropriate protective layer e.g. transfer foil (hot stamp) was formed on the surface of an image formed by sublimation thermal transfer, and the above-mentioned coating agent containing a UV-setting resin was coated via the protective layer, whereafter the above-mentioned protective film comprising a UV-setting resin layer was formed; it was found that an image-recording material can be obtained which has a distinct and stable gradation-information-bearing image with markedly improved protection and durability free of blurs in the sublimation thermal transfer dye image. Also confirmed was that this method is advantageous in that various sizes and shapes of image-recording materials with excellent image protection and durability, including ID cards such as driving license certificates, can be prepared rapidly with simple operation and equipment, forgery and alteration can be perfectly prevented, and there is no problem of occurrence of cutting dust or thermal deformation of the card substrate, which has been among the major problems occurring during lamination treatment. The inventors made further investigations based on these ideas and findings, and thus developed the present invention.

Developed with the aim of solving the problems described above, the present invention provides an image-recording material comprising a card-sized substrate, a gradation-information-bearing image layer formed on the surface of said substrate with sublimation dye by sublimation thermal transfer, a character-information-bearing image layer formed on the surface of the substrate by hot melt thermal transfer or sublimation thermal transfer, a transparent protective layer protecting the image formed by the sublimation dye, and a substantially transparent setting protective layer set by UV irradiation on the entire surface of the substrate, which has the transparent protective layer, gradation-information-bearing image layer and character-information-bearing image layer described above, and a method of producing an image-recording material comprising a process in which a gradation-information-bearing image layer is formed on the surface of a card-sized substrate with sublimation dye by sublimation thermal transfer, a process in which a character-information-bearing image layer is formed on the surface of the substrate by hot melt thermal transfer or sublimation thermal transfer, a process in which a transparent protective layer is formed on the surface of the layer having a sublimation thermal transfer image, and a process in which a substantially transparent setting protective layer set by UV irradiation is formed on the entire surface of the substrate having said transparent protective layer, gradation-information-bearing image layer and character-image-bearing image layer.

Figure 1:
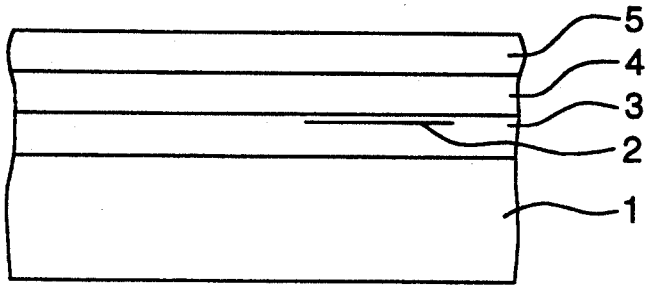
FIG. 1 is a schematic view of a mode of the thermal transfer image-recording material of the present invention.

In these figures, the numerical symbols respectively denote a support (1), an image (2), an image-receiving layer (3), a UV-absorbing resin layer (4) and a UV-setting resin layer (5).

Figure 5:
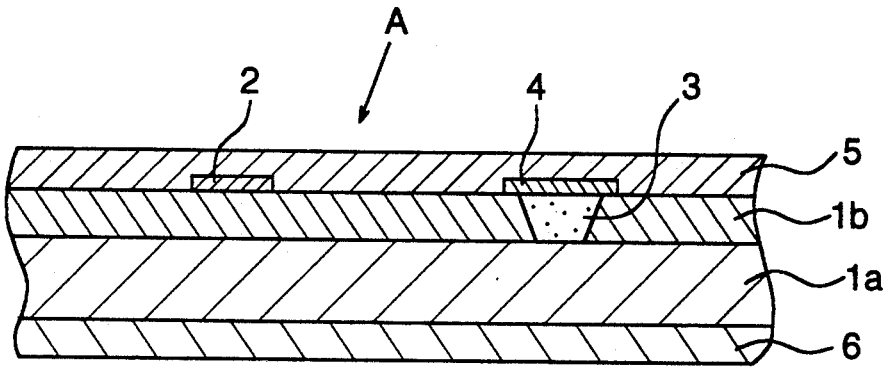

FIG. 5 is a cross-sectional view of a mode of the image-recording material of the present invention.

Figure 6:
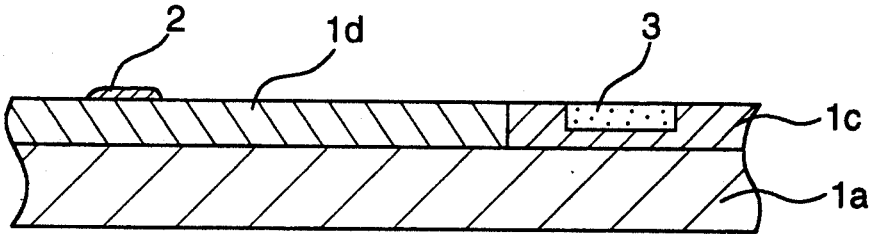

FIG. 6 is a cross-sectional view of a mode of the image-recording sheet of a mode of the image-recording material of the present invention.

In these figures, the symbols respectively denote an image-recording material (A), a support (1*a*), an image-receiving layer (1*b*) an image-receiving layer (sublimation dye) (1*c*), character-information-bearing image layer (by hot melt thermal transfer) (1*d*), a character-information-bearing image (2), a gradation-information-bearing image (3), a transparent protective layer (4) and a setting protective layer (5).

DETAILED DESCRIPTION OF THE INVENTION

The present invention is hereinafter described in detail.

The thermal transfer image-recording material of the present invention is not subject to limitation with respect to its structure except for the essential requirement that an image-receiving layer which bears an image (recording image), a UV-absorbing resin layer and a UV-setting resin layer are formed on the support in this order. For example, adhesion improving layers, cushion layers, insulating layers and other layers may be formed between the support and the image-receiving layer, and the back face of the support may be provided with backing layers and writing layers. Also, the surface of the image-receiving layer may be provided with lubricating layers and peeling layers, and the image-receiving layer may be of a multiple-layered structure.

Modes of the so structured thermal transfer image-recording material of the present invention are shown in FIGS. 1 through 4 (the common symbols denote the same elements).

FIG. 1 shows a basic structure of the thermal transfer image-recording material, wherein the image-receiving layer 3 bearing the image 2, the UV-absorbing resin layer 4 and the UV-setting resin layer 5 are formed on the support 1 in this order.

Figure 2:
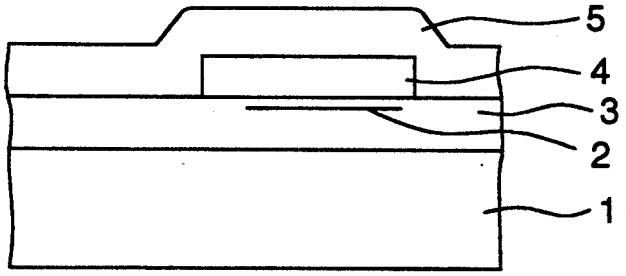
FIG. 2 is a schematic view of another mode of the thermal transfer image-recording material of the present invention.
Figure 3:
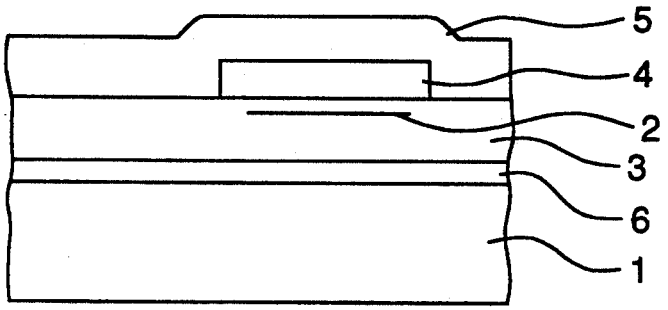
FIG. 3 is a schematic view of still another mode of the thermal transfer image-recording material of the present invention.
Figure 4:
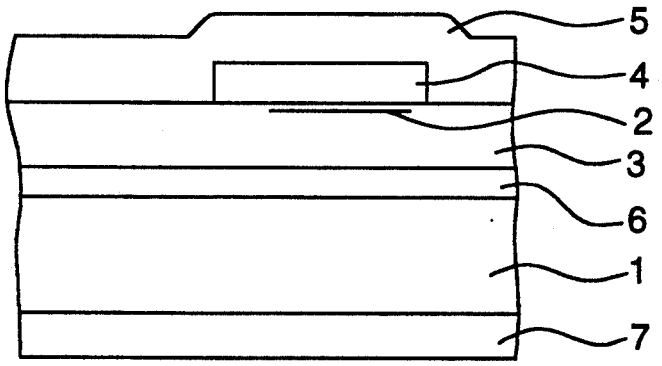
FIG. 4 is a schematic view of yet another mode of the thermal transfer image-recording material of the present invention.

In the thermal transfer image-recording material illustrated in FIG. 2, the UV-absorbing resin layer is provided partially on the image-receiving layer 3 bearing the image 2. In the thermal transfer image-recording material illustrated in FIG. 3, the adhesion improving layer 6 is provided between the support 1 and the image-receiving layer 3 in addition to the structure of FIG. 2. In the thermal transfer image-recording material illustrated in FIG. 4, the writing layer 7 is provided on the back face (opposite to the image-receiving layer) of the support 1 in addition to the structure of FIG. 3.

In any case, having the basic structure described above, the thermal transfer image-recording material of the present invention offers excellent image preservability, prevents the falsification of the image and the thermal transfer image-recording material itself and offers improved image durability.

Support

It is preferable to add a white pigment such as titanium white, magnesium carbonate, zinc oxide, barium sulfate, silica, talc, clay or calcium carbonate to the support to improve the distinctness of the image formed in the process which follows.

Although the thickness of the support varies depending on the use, it is preferably 50 to 1000 μm.

When the support itself has an image receiving property, the support may also serve as the image-receiving layer described below.

Image-receiving layer

The image-receiving layer for the present invention may be an ordinary known image-receiving layer for sublimation thermal transfer. This image receiving layer contains a binder and additives used as necessary.

In the present invention, the total amount of additives added normally ranges from 0.1 to 50% by weight of the amount of binder.

In any case, the amount of additives added is preferably such that the desired image durability is not affected.

Formation of image-receiving layer

The image-receiving layer can be formed, for example, by the coating method in which the starting components thereof are dispersed or dissolved in a solvent to prepare a coating liquid, which is coated and dried on the support, or by the lamination method in which the starting components are melt extruded and laminated on the surface of the support.

Coating can be achieved by known conventional coating methods such as gravure roll coating, extrusion coating, wire bar coating and roll coating.

Examples of solvents for these coating methods include tetrahydrofuran, methyl ethyl ketone, toluene, xylene, chloroform, dioxane, acetone, cyclohexanone, ethyl acetate and n-butyl acetate.

The image-receiving layer is formed on the surface of the support with a dry thickness of normally 1 to 50 μm, preferably 2 to 20 μm.

The surface of the image-receiving layer may be coated with a peeling layer containing a peeling agent (the above-mentioned silicon resin, modified silicon resin, silicon oil film or set silicon oil film) to facilitate the prevention of fusion with the ink sheet for thermal transfer image recording. The thickness of this peeling layer is normally 0.03 to 2.0 μm.

Ink sheet for thermal transfer recording

This ink sheet for thermal transfer recording is used to form an image on the image-receiving layer described above. It may be configured with the support and an ink layer containing a heat diffusible dye formed thereon.

Ink layer containing a heat diffusible dye

The ink layer containing a heat diffusible dye essentially contains the heat diffusible dye and a binder.

This method as well makes it possible to obtain a color image with color photographic tone. In addition, this method is advantageous in that it obviates the necessity for exchange of heat-sensitive sheets for thermal transfer recording as described above.

UV-absorbing resin layer

The UV-absorbing resin layer comprises a thermoplastic resin and a UV absorbent, which are the essential components, and additives used as appropriate.

1. Thermoplastic resin

Desirably, the thermoplastic resin shows relatively good thermal adhesion with the image-receiving layer, is substantially transparent and offers low diffusion for the image-forming heat diffusible dye. Examples of substantially transparent thermoplastic resins which show relatively good thermal adhesion include polyester resins, ethylenic resins such as EVA and EEA, vinyl chloride resins such as vinyl chloride-vinyl acetate copolymers, acrylic resins such as PMMA and other adhesive resins in common use as laminate materials. The thermoplastic resin offering low diffusion for heat diffusible dyes preferably has a low Tg value. Specifically, the thermoplastic resin preferably has a glass transition point of 40° to 120° C., though the glass transition point varied depending on the diffusibility of the heat diffusible dye used. The thermal transfer image-recording material incorporating a thermoplastic resin whose glass transition point is lower than 40° C. is unsuitable for use as a thermal transfer image-recording material where high image preservability is required because it undergoes considerable blurs of images due to diffusion of the heat diffusible dye and because the long-term heat endurance is poor. Thermoplastic resins having an excessively high glass transition point can fail to offer satisfactory adhesion upon thermal fusion or thermal transfer in the intermediate process for the production of the thermal transfer image-recording material.

2. UV absorbent

Examples of UV absorbents include the compounds described in Japanese Patent Publication Open to Public Inspection (hereinafter referred to as Japanese Patent O.P.I. Publication) Nos. 158287/1984, 74686/1988, 145089/1988, 196292/1984, 229594/1987, 283595/1986 and 204788/1989 and other publications, and known compounds known to improve the image durability in photographic and other image-recording materials.

The amount of UV absorbent added is preferably not less than 0.1 g/m$^2$, more preferably not less than 0.5 g/m$^2$. If the amount of UV absorbent added is less than 0.1 g/m$^2$, the image preservability obtained can be insufficient.

Formation of UV-absorbing resin layer

The UV-absorbing resin layer is formed at least on the image formation surface of the image-receiving layer.

To so form a UV-absorbing resin layer, the UV-absorbing resin layer is first formed on the substrate and thermally transferred to the image formation surface of the image-receiving layer by means of a thermal head or hot stamp, or a Uv-absorbing resin sheet is thermally adhered directly on the image formation surface of the image-receiving layer. Thermal transfer using a thermal head can be achieved under conditions which are normally used for hot melt thermal transfer.

Examples of the substrate include plastic films which are heat-resistant per se or have been provided with heat resistance. Specifically, a plastic film for the support for the ink sheet for thermal transfer recording or a plastic film provided with a backing layer such as a heat-resistant lubricating layer is preferably used. Although the thickness of the substrate varies depending on the method of transfer, it is preferably 3 to 10 μm from the viewpoint of thermal conductivity when using a thermal head for transfer. Direct thermal adhesion of the UV-absorbing resin sheet can be achieved by the hot stamp method or the lamination method.

UV-setting resin layer

The UV-setting resin layer for the present invention aims at preventing image damage due to friction, scratching, etc., providing durability against solvents etc. and providing preventive quality against the falsification by avoiding the atmospheric exposure of recorded image.

In the thermal transfer image-recording material of the present invention, a substantially transparent UV-setting resin layer set by UV irradiation is formed on the entire surface of the image-receiving layer including the UV-absorbing resin layer described above.

Formation of UV-setting resin layer

The UV-setting resin layer can be formed by coating a coating agent containing a UV-setting resin on the image-receiving layer including the UV-absorbing resin layer described above and irradiating ultraviolet rays.

1. Coating agent

Common UV-setting resins are radical polymerizable acrylate resins and cationic polymerizable epoxy resins, and both types can be used for the present invention.

The present invention is hereinafter described with reference to the drawings.

FIG. 5 is schematically shows a full or partial cross-sectional view of a preferred mode of the image-recording material of the present invention. This figure is not to be construed as limitative on the image-recording material of the invention but is given for the purpose of plainly describe the image-recording material and method of the invention.

In FIG. 5, the image-recording material A has a substrate 1 prepared by forming an image-receiving layer 1*b* on one face of a support 1*a*. On a given surface of the image-receiving layer lb are formed a gradation-information-bearing image 3 formed by sublimation thermal transfer and a character-information-bearing image 2 formed by hot melt thermal transfer. On the surface of the gradation-information-bearing image 3 is formed a transparent protective layer 4, and on the entire surface of the substrate 1, having the gradation-information-bearing image 3 with the transparent protective layer 4 and the character-information-bearing image 2, is formed a setting protective layer 5, and on the opposite face of the substrate 1 is formed a writing layer 6.

The substrate, the gradation-information-bearing image, the character-information-bearing image, the transparent protective layer and the setting protective layer, including the mode illustrated in FIG. 5, are hereinafter described in detail in this order.

A. Substrate

Any substrate can be used to produce an image-recording material of the present invention with no limitation, as long as it permits formation of both a gradation-information-bearing image by sublimation thermal transfer and a character-information-bearing image by hot melt thermal transfer or sublimation thermal transfer and as long as its mechanical properties, such as strength and rigidity, are sufficient to endure card use. For card use, to ensure sufficient mechanical properties, a substrate comprising laminated sheets of the same kind or different kinds may be used. Moreover, it is also possible to use a substrate prepared by printing information common among the same kind of cards on a visible layer. It is also possible to use a substrate subjected to a confirmable special anti-forgery treatment by physical means such as watermarks to prevent the forgery and alteration of the card itself.

When the support itself is formed with a material capable of forming at least a gradation-information-bearing image, preferably both a gradation-information-bearing image and a character-information-bearing image as another preferred mode of the substrate for the present invention, the support itself may be used as the substrate. In this case, the support serves as an image-receiving layer which receives sublimation dyes.

The image-receiving layer may be provided on the support, whether on one or both faces and whether on the entire surface or the desired part alone. Also, with respect to this image-receiving layer, in forming a gradation-information-bearing image 3 and a character-information-bearing image 2 as illustrated in FIG. 2, a first image-receiving layer 1*c*, prepared to permit good reception of sublimation dye, and a second image-receiving layer 1*d*, prepared to permit good adhesion of hot melt ink, may be separately provided on a given surface of the image-receiving layer prepared to permit good formation of both a gradation-information-bearing image and a character-information-bearing image to simplify the production process and enhance the applicability. When forming a gradation-information-bearing or character-information-bearing layer, the surface of the support may be provided with a cushion layer or insulating layer to prevent printing failure and improve sensitivity as described in Japanese Patent O.P.I. Publication Nos. 236794/1985 and 258793/1986.

As another mode of the substrate for the present invention, the substrate may be formed with a support alone which is not capable of receiving sublimation dyes but capable of well adhering hot melt ink. In this case, to form a gradation-information-bearing image on the surface of the substrate, the image is first formed on a transferee having an image-receiving layer with sublimation dye by sublimation thermal transfer and then the image thus recorded on the transferee, along with the image-receiving layer of the transferee, is transferred to the surface of the support.

The substrate is not subject to limitation with respect to its shape; various sizes and various shapes (including sheets and blocks) can be used. When preparing cards, for instance, a substrate previously prepared to the desired card size may be used, or the bulk substrate may be cut into the desired size at any time point during production of the image-recording material of the present invention.

Also, the substrate may be provided with embossing, signs, IC memories, photomemories, magnetic recording layers and other prints and devices as necessary. It is also possible to provide embossing, signs, magnetic recording layers, etc. in any time point during (e.g., after forming the transparent protective layer) or after producing the image-recording material of the present invention.

Next, the support and the image-receiving layer are described in detail.

A.1. Support

Examples of materials for the support include various papers such as ordinary paper, coat paper and synthetic paper (polypropylene, polystyrene or composite thereof with paper), various plastic films or sheets such as white vinyl chloride resin sheets, white polyethylene terephthalate base films, transparent polyethylene terephthalate base films and polyethylene naphthalate base films, films or sheets formed with various metals, and films or sheets of various ceramics.

It is preferable to add a white pigment such as titanium white, magnesium carbonate, zinc oxide, barium sulfate, silica, talc, clay or calcium carbonate to the support to improve the distinctness of the image formed in the process which follows.

When the image-recording material is prepared as an ID card such as a driving license certificate, it is a common practice to configure the support with a sheet or film comprising a composition of the white pigment described above and the vinyl chloride resin described below.

When the substrate is formed as a lamination of the support and the image-receiving layer, the thickness of the support is normally 100 to 1000 μm, preferably 100 to 800 μm. When the substrate is formed with the support alone, the thickness of the support is normally 100 to 1000 μm, preferably 200 to 800 μm.

When the substrate is provided with embossing, signs, IC memories, photomemories, magnetic recording layers and other prints and devices as necessary, it is preferable to provide the embossing, signs, IC memories, photomemories, magnetic recording layers and other prints and devices on this support.

A.2 Image-receiving layer

When an image-receiving layer is formed on the surface of the support, the image-receiving layer can be formed with a binder and various additives. As the case may be, it may be formed with a binder alone. The image-receiving layer for the present invention is used to form both an image with sublimation dye by sublimation thermal transfer and another image by hot melt thermal transfer. In this case, the dyability of the sublimation dye should be good and the adhesion of the hot melt ink should be good. To obtain such a specially characteristic image-receiving layer, it is necessary to select appropriate kinds of binder and additives and appropriately adjust their contents as described below.

The components of the image-receiving layer are hereinafter described in detail.

A.2.1. Binder

Commonly known binders for sublimation thermal transfer recording can be used as appropriate in the image-receiving layer for the present invention. Examples of binders which can be used for the present invention include vinyl chloride resins, polyester resins, polycarbonate resins, acrylic resins and various heat-resistant resins. However, when an actual requirement, such as any heat resistance for the ID card issued, exists with respect to the image formed by the present invention, consideration should be given to select one or more kinds of binder to meet such a requirement. If the heat resistance desired is such that the image endures temperatures over 60° C., it is preferable to use a binder having a Tg value of over 60° C. in view of blurs of sublimation dye.

Although any kind of binder can be selected, preference is given to vinyl chloride resin from the viewpoint of image preservability and other features. Examples of the vinyl chloride resin include polyvinyl chloride resin and vinyl chloride copolymer. Examples of the vinyl chloride copolymer include copolymers of vinyl chloride and another comonomer containing over 50 mol % of vinyl chloride as monomer unit.

Examples of the other comonomer include vinyl esters of fatty acid such as vinyl acetate, vinyl propionate, vinyl acetate and vinyl ester of cow's fatty acid, acrylic acid, methacrylic acid, alkyl esters thereof such as methyl acrylate, ethyl methacrylate, butyl acrylate, 2-hydroxyethyl methacrylate and 2-ethylhexyl acrylate, maleic acid, alkylalkyl esters thereof such as diethyl maleate, dibutyl maleate and dioctyl maleate, and alkyl vinyl ethers such as methylvinyl ether, 2-ethylhexylvinyl ether, laurylvinyl ether, palmitylvinyl ether and stearylvinyl ether. Examples of the comonomer include ethylene, propylene, acrylonitrile, methacrylonitrile, styrene, chlorostyrene, itaconic acid and alkyl esters thereof, crotonic acid and alkyl esters thereof, dichloroethylene, trichloroethylene, halogenated olefins, cycloolefins such as cyclopentene, aconitates, vinyl benzoate and benzoylvinyl ether.

The vinyl chloride copolymer may be any of block copolymer, graft copolymer, alternative copolymer and random copolymer. As the case may be, the vinyl chloride copolymer may be a copolymer with a compound having peeling function such as a silicon compound.

In addition to the vinyl chloride resins described above, polyester resins can also preferably be used in the image-receiving layer for sublimation thermal transfer. Examples of polyester resins which can be used for the present invention include the compounds described in Japanese Patent O.P.I. Publication Nos. 188695/1983 and 244696/1987. Polycarbonate resins can also be used as binders, including the various compounds described in Japanese Patent O.P.I. Publication No. 169494/1987.

The heat-resistant resin may be any known heat-resistant resin, as long as it has high heat resistance, its softening point or glass transition point Tg is not extremely low, it is well compatible with the vinyl chloride resin described above, and it is substantially colorless. Here, "heat resistance" means that the resin itself does not undergo yellowing or other color change nor extreme deterioration of the physical strength during high temperature storage.

The heat-resistant resin preferably has a softening point of 50° to 200° C. and a Tg value of 80° to 150° C.

Softening points of lower than 50° C. are undesirable because fusion can occur between the ink sheet and the image-receiving layer upon transfer of heat diffusible dye. Softening points exceeding 200° C. are undesirable because the sensitivity of the image-receiving layer decreases.

Examples of heat-resistant resins meeting these requirements include phenol resin, melamine resin, urea resin and ketone resin, with preference given to urea-aldehyde resin and ketone resin.

Urea-aldehyde resin is obtained by condensation of urea and aldehyde (mainly formaldehyde), while ketone resin is obtained by condensation of ketone and formaldehyde. Depending on the starting material ketone, various types are available, all of which can be used for the present invention.

Examples of the starting material ketone include methyl ethyl ketone, methyl isobutyl ketone, acetophenone, cyclohexanone and methylcyclohexanone.

Examples of easily available urea-aldehyde resins include Laropearl A81 and Laropearl A101 (both produced by BASF). Examples of easily available ketone resins include Laropearl K80 (produced by BASF).

The binder selected from the various resins for the present invention may be hardened with isocyanate hardeners, UV-setting resins and other means to improve properties, e.g., improvement in the film strength of the image-receiving layer, prevention of sublimation dye fusion upon its transfer and prevention of sublimation dye blurs. In addition to these hardeners, appropriate additives may be added to improve the properties of the image-receiving layer.

A.2.2 Additives

Peeling agents, antioxidants, UV absorbents, light stabilizers, fillers (inorganic micrograins, organic resin grains) and pigments may be added to the image-receiving layer. Plasticizers, hot solvents and other substances may be added as sensitizers.

The peeling agent improves the detachability between the ink sheet for sublimation thermal transfer described below and the image-receiving layer.

Examples of such peeling agents include silicone oil (including silicone resin), solid waxes such as polyethylene wax, amide wax and Teflon powder, and fluorine or phosphate surfactants, with preference given to silicone oil.

Silicone oil is available in two types, namely the simple addition type and the setting or reaction type.

In the case of the simple addition type, it is preferable to use modified silicone oil to improve the compatibility with binder.

Examples of modified silicone oil include polyester-modified silicon resin (or silicon-modified polyester resin), acryl-modified silicon resin (or silicon-modified acrylic resin), urethane-modified silicon resin (or silicon-modified urethane resin), cellulose-modified silicon resin (or silicon-modified cellulose resin), alkyd-modified silicon resin (or silicon-modified alkyd resin) and epoxy-modified silicon resin (or silicon-modified epoxy resin).

Accordingly, polyester-modified silicon resins having polysiloxane resin in their main chain prepared by block copolymerization of polyester, silicon-modified polyester resins having a dimethylpolysiloxane moiety as a side chain bound to the polyester chain, dimethylpolysiloxane-polyester block copolymers, alternating copolymers, graft copolymers and random copolymers can also be used as modified-silicone oil or resin.

In the present invention, it is preferable to add a peeling agent having good compatibility with the binder for the image-receiving layer from the viewpoint of hot melt ink transferability, protective layer transferability, and the coatability of the coating liquid containing a UV-setting resin for the formation of setting protective layer. When using vinyl chloride resin as binder, for instance, polyester-modified silicon resin is preferably used in combination therewith.

Typical examples of polyester-modified silicon resins include copolymers of diol and dibasic acid, polyester-dimethylpolysiloxane block copolymers which are caprolactone ring-opened polymers (including copolymers wherein one or both ends of dimethylsiloxane are blocked by the polyester moiety, and vice versa), and copolymers comprising the polyester as the main chain and (dimethyl)polysiloxane bound thereto as the side chain.

Although the amount of such silicone oil of the simple addition type added cannot be set indiscriminately because it varies depending on the type of silicone oil, it is normally 0.5 to 50% by weight, preferably 1 to 20% by weight of the binder in the image-receiving layer.

Examples of silicone oils of the setting or reaction type include reaction setting silicone oils, light setting silicone oils and catalytic setting silicone oils.

Examples of reaction setting silicone oils include those prepared by reaction setting of amino-modified silicone oil and epoxy-modified silicone oil.

Examples of catalytic setting or light setting silicone oils include KS-705F-PS, KS-705F-PS-1 and KS-770-PL-3 (all catalytic setting silicone oils, produced by Shin-Etsu Chemical Co., Ltd.), and KS-720 and KS-774-PL-3 (both light setting silicone oils, produced by Shin-Etsu Chemical Co., Ltd.).

The amount of these setting silicone oils added is preferably 0.5 to 30% by weight of the binder for the image-receiving layer.

On a part of the surface of the image-receiving layer, a peeling agent layer may be provided by, for example, coating and then drying the peeling agent in solution or dispersion in an appropriate solvent.

Examples of the antioxidant include the antioxidants described in Japanese Patent O.P.I. Publication Nos. 182785/1984, 130735/1985 and 127387/1989 and known compounds which are used to improve the image durability in photographic and other image recording materials.

Examples of the UV absorbent and light stabilizer include the compounds described in Japanese Patent O.P.I. Publication Nos. 158287/1984, 74686/1988, 145089/1988, 196292/1984, 229594/1987, 122596/1988, 283595/1986 and 204788/1989 and known compounds which are used to improve the image durability in photographic and other image recording materials.

Examples of the filler include inorganic micrograins and organic resin grains. These inorganic micrograins include silica gel, calcium carbonate, titanium oxide, acid clay, active clay and alumina. The organic micrograins include grains of resins such as fluorine resin, guanamine resin, acrylic resin and silicon resin. Although varying depending on the specific gravity, the amount of these inorganic or organic resin grains added is preferably 0.1 to 70% by weight.

Typical examples of the pigment include titanium white, calcium carbonate, zinc oxide, barium sulfate, silica, talc, clay, kaolin, active clay and acid clay.

Examples of the plasticizer include phthalates such as dimethyl phthalate, dibutyl phthalate, dioctyl phthalate and didecyl phthalate, trimellitates such as octyl trimellitate, isononyl trimellitate and isodecyl trimellitate, pyromellitates such as octyl pyromellitate, adipates such as dioctyl adipate, methyllauryl adipate, di-2-ethylhexyl adipate and ethyllauryl adipate, oleates, succinates, maleates, sebacates, citrates, epoxidated soybean oil, epoxidated linseed oil, epoxystearic acid epoxys, phosphates such as triphenyl phosphate and tricresyl phosphate, phosphites such as triphenyl phosphite, Tris-tridecyl phosphite and dibutyl hydrogen phosphite and glycol esters such as ethylphthalylethyl glycolate and butylphthalylbutyl glycolate. Since the addition of plasticizer in excess deteriorates the image preservability, the amount of plasticizer added normally ranges from 0.1 to 30% by weight of the binder in the image-receiving layer.

A.3. Writing layer

On the face opposite to the image-receiving layer formation face of the support there may be formed a writing layer. When the image-recording material is prepared as an ID card such as a driving license certificate, it is very preferable to provide a writing layer. This is because it is advantageous to form a writing layer in that various pieces of information can be written on the ID card.

The writing layer for the present invention is not described in detail here. For details, refer to the description given under the heading "Writing layer" in Japanese Patent O.P.I. Publication No. 205155/1989, line 14, upper right column, through line 2, lower right column, page 4.

A.4. Production of substrate

The substrate for the present invention can be produced by the coating method in which the starting components of the image-receiving layer is dispersed or dissolved in a solvent to yield an image-receiving layer coating liquid, which is coated and dried on the surface of the support.

The substrate can also be produced by the lamination method in which a mixture of the image-receiving layer components is melt extruded and laminated on the surface of the support.

Examples of the solvent for the coating method include conventional solvents such as water, alcohol, methyl ethyl ketone, toluene, dioxane and cyclohexanone.

The lamination method can be used in combination with coextrusion.

The image-receiving layer may be formed on the entire surface of the support or on a part of the surface of the support.

The thickness of the image-receiving layer formed on the surface of the support is normally about 2 to 50 μm, preferably about 3 to 20 μm.

When the image-receiving layer itself serves as the support because of its self-supportability and also as the substrate, its thickness is preferably about 60 to 200 μm, preferably about 90 to 150 μm.

With respect to this image-receiving sheet for thermal transfer recording, the image-receiving layer may be provided with a peeling layer containing a peeling agent (the above-mentioned silicon resin, modified-silicon resin, silicon oil film or hardened silicon oil film) to enhance the preventive effect on the fusion with the ink layer of the ink sheet for thermal transfer recording.

The thickness of the peeling layer is normally 0.03 to 2.0 μm.

With respect to the substrate for the present invention, a cushion layer or barrier layer may be provided between the support and the image-receiving layer.

Providing a cushion layer makes it possible to transfer record the image corresponding to the image information with high reproducibility and reduced noise.

Examples materials for the cushion layer include urethan resin, acrylic resin, ethylene resin, butadiene rubber and epoxy resin.

The thickness of the cushion layer is normally 1 to 50 μm, preferably 3 to 30 μm.

Providing a barrier layer makes it possible to prevent dye diffusion into the support and prevent dye blurs in the support. Examples of materials for the barrier layer include gelatin, casein and other hydrophilic binders and high-Tg polymers.

B. Gradation-information-bearing image

The gradation-information-bearing image mentioned herein means an image formed with sublimation dye. Many of the images formed with sublimation dye possess monochrome or color gradation. When the image-recording material is an ID card such as a driving license certificate, the gradation-information-bearing image is often a personal figure image. However, when the image-recording material is a prepaid card such as a telephone card, or a name card or advertising card, the gradation-information-bearing image may be a landscape, picture, abstract pattern as well as a personal figure image.

The gradation-information-bearing image is formed on the image-receiving layer by the image forming method described below using the ink sheet for sublimation thermal transfer recording described below.

B.1. Ink sheet for sublimation thermal transfer recording

The ink sheet for sublimation thermal transfer recording can be configured with the support and an ink layer containing a sublimation dye formed thereon.

B.1.1. Ink layer containing a sublimation dye

The ink layer containing a sublimation dye essentially contains the sublimation dye and a binder.

B.1.1.1. Sublimation dye

Examples of sublimation dyes include cyan dye, magenta dye and yellow dye.

Examples of the cyan dye include the naphthoquinone dyes, anthraquinone dyes and azomethine dyes described in Japanese Patent O.P.I. Publication Nos. 78896/1984, 227948/1984, 24966/1985, 53563/1985, 130735/1985, 131292/1985, 239289/1985, 19396/1986, 22993/1986, 31292/1986, 31467/1986, 35994/1986, 49893/1986, 148269/1986, 191191/1987, 91288/1988, 91287/1988 and 290793/1988.

Examples of the magenta dye include the anthraquinone dyes, azo dyes and azomethine dyes described in Japanese Patent O.P.I. Publication Nos. 78896/1984, 30392/1985, 30394/1985, 253595/1985, 262190/1986, 5992/1988, 205288/1988, 159/1989 and 63194/1989.

Examples of the yellow dye include the methine dyes, azo dyes, quinophthalone dyes and anthraisothiazole dyes described in Japanese Patent O.P.I. Publication Nos. 78896/1984, 27594/1985, 31560/1985, 53565/1985, 12394/1986, and 122594/1988.

The particularly preferable sublimation dyes are azomethine dyes obtained by coupling of a compound having an active methylene group of the chain-opened or -closed type with the oxidation product of a p-phenylenediamine derivative or p-aminophenol derivative, and indoaniline dyes obtained by coupling with the oxidation product of a phenol, naphthol, p-phenylenediamine or p-aminophenol derivative.

The sublimation dye contained in the ink layer may be any of yellow, magenta and cyan dyes, as long as the image to be formed is monochromic. For some tones of the image to be formed, two or more of the three kinds of dye and other sublimation dyes may be contained.

The amount of the sublimation dye used is normally 0.1 to 20 g, preferably 0.2 to 5 g per $m^2$ of support.

B.1.1.2. Binder

Examples of the binder for the ink layer containing a sublimation dye include cellulose resins such as ethyl cellulose, hydroxyethyl cellulose, ethylhydroxyethyl cellulose, hydroxypropyl cellulose, methyl cellulose, cellulose acetate and cellulose acetobutyrate, vinyl resins such as polyvinyl alcohol, polyvinyl formal, polyvinyl butyral, polyvinyl pyrrolidone, polyester, polyvinyl acetate, polyacrylamide, polyvinyl acetacetal, styrene resin, styrene copolymer resin, polyacrylates, polyacrylic acid and acrylic acid copolymers, rubber resins, ionomer resins and olefinic resins.

Of these resins are preferred polyvinyl butyral, polyvinyl acetacetal and cellulose resin, which have excellent acid resistance.

These various binders may be used singly or in combination.

The weight ratio of the binder and the sublimation dye is preferably 1:10 to 10:1, more preferably 2:8 to 8:2.

B.1.1.3. Other optional components

Various additives may be added to the ink layer containing the sublimation dye, as long as the object of the invention is not interfered with.

Examples of such additives include peeling compounds such as silicon resin, silicon oil (reaction setting type acceptable), silicon-modified resin, fluorine resin, surfactants and waxes, fillers such as metal micropowder, silica gel, metal oxides, carbon black and resin micropowder, and setting agents capable of reaction with binder components such as radiation-activated compounds of isocyanates, acrylics and epoxys.

Hot melt substances can also be added to promote transfer, including the waxes, higher fatty acid esters and other hot melt substances described in Japanese Patent O.P.I. Publication No. 106997/1984.

B.1.2. Support

Any material can be used for the support for the ink sheet for sublimation thermal transfer recording, as long as it has good dimensional stability and endures heating using a thermal head during recording. Specifically, there can be used the films and sheets described in Japanese Patent O.P.I. Publication No. 193886/1988, lines 12 through 18, lower left column, page 2.

The thickness of the support is preferably 2 to 10 μm. The support may have a subbing layer for the purpose of improvement in its adhesion with binder and prevention of dye transfer and migration to the support.

On the back face of the support (opposite to the ink layer containing a sublimation dye), an anti-sticking layer may be provided to prevent the fusion and sticking of the head to the support and wrinkling.

The thickness of the anti-sticking layer is normally 0.1 to 1 μm.

The support is not subject to limitation as to its shape; it may have any shape, including broad sheets and films and narrow tapes and cards.

B.2. Production of ink sheet for sublimation thermal transfer recording

An ink sheet for sublimation thermal transfer recording can be produced by dissolving or dispersing the various starting components of the ink layer containing a sublimation dye in a solvent to yield a coating liquid for the ink layer containing a sublimation dye and coating and drying it on the surface of the support.

The binders are used singly or in combination in solution in a solvent or in dispersion in latex.

Examples of the solvent include water, alcohols such as ethanol and propanol, cellosolves such as methyl cellosolve and ethyl cellosolve, aromatic compounds such as toluene, xylene and chlorobenzene, ketones such as acetone and methyl ethyl ketone, ester solvents such as ethyl acetate and butyl acetate, ethers such as tetrahydrofuran and dioxane and chlorine solvents such as chloroform and trichloroethylene.

The coating process can be achieved by conventional coating methods such as gravure roll sequential coating, extrusion coating, wire bar coating and roll coating.

An ink layer containing a single sublimation dye may be formed on the entire surface of the support or on a part of the surface, or an ink layer containing a binder and a yellow sublimation dye, an ink layer containing a binder and a magenta sublimation dye and an ink layer containing a binder and a cyan sublimation dye may be formed in a given pattern of repeats in the horizontal direction on the entire surface of the support or on a part of the surface.

The thickness of the ink layer containing a sublimation dye thus formed is normally 0.2 to 10 μm, preferably 0.3 to 3 μm.

In the present invention, convenience can be offered by forming perforations or making detection marks etc. for the detection of the positions of zones with different hues in the ink sheet for sublimation thermal transfer recording.

The ink sheet for sublimation thermal transfer recording should not necessarily comprise a support and a heat-sensitive layer formed thereon, but may have other layers formed on the surface of the ink layer containing the sublimation dye.

For example, an overcoat layer may be provided to prevent fusion with the image-receiving sheet for thermal transfer recording and sublimation dye blocking.

B.3. Formation of gradation-information-bearing image

To form a gradation-information-bearing image, the ink layer containing a sublimation dye of the ink sheet for sublimation thermal transfer recording is superposed on the image-receiving surface of the substrate, and heat energy is imagewise given to the ink layer containing the sublimation dye and the image-receiving layer.

The sublimation dye in the ink layer containing the sublimation dye vaporizes or sublimates in the amount corresponding to the heat energy given and migrates to the image-receiving layer, where it is received.

As a result, a gradation-information-bearing image is formed on the image-receiving layer.

A thermal head is commonly used as a light source to give the heat energy, but other known means such as laser beams, infrared flash light and thermal pens can be used.

When using a thermal head as a heat source to give heat energy, the intensity of heat energy given can be continuously or stepwise changed by altering the voltage or pulse width applied.

When using a laser beam as a heat source to give heat energy, the intensity of heat energy given can be changed by altering the intensity of the laser beam or irradiation area.

In this case, to facilitate the absorption of laser beam, a laser beam absorbent, such as carbon black or infrared absorbent in the case of semiconductor laser, may be contained in or near the ink layer containing the sublimation dye.

When using a laser beam, it is recommended to keep in close contact the ink sheet for sublimation thermal transfer recording and the image-receiving sheet for thermal transfer recording.

The use of a dot generator equipped with an acousto-optical element makes it possible to give heat energy in intensities according to dot size.

When using an infrared flash lamp as a light source to give heat energy, it is recommended to carry out heating via a black or otherwise colored layer as in the case of laser beams.

Heating may also be carried out via a black or otherwise colored pattern with continuous gradation of image density or dot pattern, or by using in combination a black or otherwise colored layer with a negative pattern corresponding to the pattern described above.

Although heat energy may be given from any of the side of the ink sheet for sublimation thermal transfer recording, the substrate side or both, it is desirable to give heat energy from the side of the ink sheet for sublimation thermal transfer recording from the viewpoint of efficient use of heat energy.

The sublimation thermal transfer recording method described above makes it possible to record a single-colored image on the image-receiving layer of the substrate. On the other hand, the following method makes it possible to obtain a color image with color photographic tone comprising various colors.

For example, a color image with color photographic tone comprising different colors can be obtained by carrying out thermal transfer according to the respective colors while sequentially replacing yellow, magenta, cyan and if necessary black heat-sensitive sheets for thermal transfer recording.

The following method is also effective. In spite of the ink sheets for sublimation thermal transfer recording for respective colors, an ink sheet for sublimation thermal transfer recording having separate zones with respective colors is used.

First, the yellow zone is used to thermally transfer the yellow color separation image, followed by the use of the magenta zone to thermally transfer the magenta color separation image, and so on, whereby yellow, magenta, cyan, and if necessary black color separation images are sequentially thermally transferred.

C. Character-information-bearing image

C.1. Hot melt ink sheet

The hot melt ink sheet comprises a support and a hot melt ink layer formed thereon. It may have other layers, as long as its properties are not affected. For example, a peeling layer may be provided between the hot melt ink layer and the support, and an interlayer and other layers may be formed between the peeling layer and the support. Also, other layers may be formed on the hot melt ink layer, such as an ink protective layer on the outermost layer. The peeling layer and hot melt ink layer may be prepared to have a multiple-layered structure as necessary.

Next, the configuration of the hot melt ink sheet for the present invention is described in the order of the support, peeling layer and hot melt ink layer.

C.1.1. Support

The support for the hot melt ink sheet desirably has good heat resistance and high dimensional stability.

Examples of materials for the support include the films and sheets described in Japanese Patent O.P.I. Publication No. 193886/1988, lines 12 through 18, lower left column, page 2.

The thickness of the support is normally not more than 30 μm, preferably between 2 and 30 μm. If the thickness of the support exceeds 30 μm, thermal conductivity deterioration can result in printing quality degradation.

The hot melt ink sheet is not subject to limitation as to the configuration of the back face of the support; for example, a backing layer such as an anti-sticking layer may be provided.

C.1.2. Hot melt ink layer

The hot melt ink layer comprises a hot melt compound, a thermoplastic resin, a colorant and other components.

Any hot melt compound can be used, as long as it is commonly used in the hot melt ink layer for this kind of hot melt ink sheets. Examples of such hot melt compounds include low molecular thermoplastic resins such as polystyrene resin, acrylic resin, styrene-acrylic resin, polyester resin and polyurethane resin and the substances exemplified in Japanese Patent O.P.I. Publication No. 193886/1988, line 8, upper left column through line 12, upper right column, page 4, and rosin and rosin derivatives such as hydrogenated rosin, polymerized rosin, rosin-modified glycerol, rosin-modified maleic resin, rosin-modified polyester resin, rosin-modified phenol resin and ester rubber, and phenol resin, terpene resin, ketone resin, cyclopentadiene resin and aromatic hydrocarbon resin.

These hot melt compounds preferably have a molecular weight of not more than 10,000, more preferably not more than 5,000 and a melting point or softening point of 50° to 150° C.

The hot melt compounds may be used singly or in combination.

Various thermoplastic resins can be used in the hot melt ink layer, including those which are commonly used in the hot melt ink layer of this kind of hot melt ink sheets, such as the substances exemplified in Japanese Patent O.P.I. Publication No. 193886/1988, upper right column, page 4 through line 18, upper left column, page 5.

Any colorant can be used in the hot melt ink layer with no limitation, as long as it is commonly used in the hot melt ink layer of this kind of hot melt ink sheets. Examples of such colorants include the organic and inorganic pigments and organic dyes described in Japanese Patent O.P.I. Publication No. 193886/1988, lines 3 through 15, upper right column, page 5.

These colorants may be used singly or in combination as necessary.

To the hot melt ink layer, there may be added other additives, as long as the object of the present invention is not interfered with.

The hot melt ink layer may contain a fluorine surfactant, for instance. The presence of fluorine surfactant prevents the blocking phenomenon in the ink layer.

Also, it is effective to add organic micrograins, inorganic micrograins or incompatible resin to improve the sharpness of the transferred character-information-bearing image, i.e., the sharpness in the character borders.

The thickness of the hot melt ink layer is normally 0.6 to 5.0 μm, preferably 1.0 to 4.0 μm.

Although the hot melt ink layer may be formed by the organic solvent method, in which the components are coated in dispersion or solution in organic solvent, or by the hot melt coating method, in which a thermoplastic resin etc. are coated while being softened or melted by heating, it is preferable to prepare it by coating an emulsion or solution of the components in water or organic solvent.

The total content of the layer-forming components in the coating liquid for the hot melt ink layer is set normally in the range from 5 to 50% by weight.

Coating can be achieved by ordinary methods, including wire bar coating, squeeze coating and gravure coating.

Although at least one hot melt ink layer is necessary, two or more hot melt ink layers with different types or contents of colorants, different ratios of thermoplastic resin and hot melt compound may be formed.

C.1.3. Peeling layer

The major purpose of forming the peeling layer is to ensure satisfactorily rapid detaching and transfer of at least the layers formed on the peeling layer (at least one of which layers contains a colorant) upon heating by a heating mechanism for image transfer such as a thermal head during image formation. A hot melt compound suitable for this purpose is added to prepare a layer wherein the properties of the hot melt compound, specifically the excellent peeling property dominates.

Although the peeling layer may comprise the hot melt compound alone, it preferably comprises the hot melt compound and/or a binder resin such as a thermoplastic resin.

The hot melt compound used as the major component of the peeling layer is any known one, including the substances exemplified in Japanese Patent O.P.I. Publication No. 193886/1988, lines 8, upper left column, page 4 through line 15, upper right column, page 5.

The hot melt compound used as the major component of the peeling layer of the hot melt ink sheet is preferably a microcrystalline wax, paraffin wax or carnauba wax having a melting point or softening point of 50° to 100° C. among the hot melt compounds exemplified above. Too high melting points or softening points can hamper the obtainment of the desired sufficient detachability, particularly in high speed printing. Too low melting points or softening points can cause a failure of peeling under ordinary conditions.

These hot melt compounds may be used singly or in combination.

The binder resin in the peeling layer or the thermoplastic resin used as a component thereof is not subject to limitation; any known resin can be used, as long as it is used in the peeling layer of this kind of ink sheet for hot melt thermal transfer recording.

Examples of the thermoplastic resin include ethylenic copolymers such as ethylene-vinyl acetate resin, polyamide resin, polyester resin, polyurethane resin, polyolefin resin, acrylic resin and cellulose resin. As the case may be, also usable are resins such as vinyl chloride resin, rosin resin, petroleum resin, ionomer resin, elastomers such as natural rubber, styrene-butadiene rubber, isoprene rubber and chloroprene rubber, rosin derivatives such as ester rubber, rosin-maleic resin, rosin-phenolic resin and hydrogenated rosin, phenol resin, terpenone resin, cyclopentadiene resin and aromatic resins.

Of these substances, ethylenic copolymers such as ethylene-vinyl acetate copolymer or ethylene-vinyl acetate based copolymer, and cellulose resin are preferable, with more preference given to ethylene-vinyl acetate copolymer and cellulose resin.

These thermoplastic resins may be used singly or in combination.

In the present invention, the thermoplastic resin used as a component of the peeling layer preferably has a melting point or softening point of 50° to 150° C., more preferably 60° to 120° C. among the various thermoplastic resins exemplified above, or a mixture thereof whose melting point or softening point falls in these ranges.

The peeling layer may contain a colorant.

When the peeling layer contains a colorant, its content is normally not more than 30% by weight, preferably not more than 20% by weight of the total components of the peeling layer.

Ordinary colorants can be used for this purpose; the same colorants as those exemplified in the paragraph "C.1.2. Hot melt ink layer" can be used.

The peeling layer may further contain other components as necessary, as long as the object of the present invention is not interfered with. Examples of such other components include higher fatty acids, higher alcohols, higher fatty acid esters, amides and higher amines. These substances may be used singly or in combination.

The thickness of the peeling layer normally ranges from 0.2 to 4 μm, preferably from 0.5 to 2.5 μm.

In addition to the components described above, the peeling layer may contain a surfactant for adjusting the detachability. Typical examples of surfactants used for the present invention include compounds with a polyoxyethylene chain. There can also be added inorganic or organic micrograins such as metal powder and silica gel and oils such as linseed oil and mineral oil.

The peeling layer serves mainly to adjust the adhesion between the hot melt ink layer formed thereon and the support, facilitating the peeling of these layers from the support by heating from the back face (the side where the peeling layer and other layers are not formed) of the support using a thermal head, for instance.

In other words, the peeling layer makes the hot melt ink layer to be rapidly peeled and transferred onto the substrate upon release of the hot melt ink layer from the support while maintaining film adhesion to the support, film strength and other mechanical properties of the hot melt ink layer.

C.2. Formation of character-information-bearing image

The present hot melt transfer method using a hot melt ink sheet is not different from the ordinary thermal transfer recording method. It is described for the case where a thermal head, the most typical source of heat, is used.

First, the hot melt ink layer of the hot melt ink sheet and the image-receiving surface of the substrate are placed in close contact with each other, and while providing thermal pulse by means of a thermal head from the back of the substrate using a platen as necessary, the hot melt ink layer corresponding to the desired printing or transfer pattern is heated locally.

The heated portion of the hot melt ink layer becomes hot and quickly softens and is transferred onto the image-receiving surface of the substrate.

This character-information-bearing image may be formed before the formation of the gradation-information-bearing image, and vice versa.

D. Transparent protective layer

In the image-recording material of the present invention, it is important that the transparent protective layer is provided at least on the gradation-information-bearing image or character-information-bearing image layer formed by sublimation thermal transfer.

The major purposes of providing the transparent protective layer are as follows. In forming a setting protective layer comprising a resin setting product set by UV irradiation to improve the protection, durability and other properties of the image or the image-recording material, if the coating agent containing a UV-setting resin is coated directly on the gradation-information-bearing image, blurs, discoloration and other failures are caused in the gradation-information-bearing image formed by sublimation dye, due to the action of UV-setting resin and solvent present in the coating agent, which hampers the obtainment of a distinct image. To overcome this drawback, a transparent protective layer is provided as above to avoid the contact of the sublimation dye image with the coating agent to prevent the blurs and discoloration of the sublimation dye and hence keep the formed image distinct.

The transparent protective layer should be provided also for the purpose of effectively preventing the deterioration (attributable to decomposition and reaction with other substances) and discoloration of the sublimation dye by the UV irradiation during formation of the setting protective layer.

However, the gradation-information-bearing image must not be affected by the provision of the transparent protective layer on the surface thereof.

To summarize, the requirements of the transparent protective layer include transparency, minimization of diffusive migration of sublimation dye, minimization of UV interference on the sublimation dye during UV irradiation, and avoidance of the contact of the coating agent with the sublimation dye during coating the coating agent.

The region coated by the transparent protective layer may cover the gradation-information-bearing image layer alone or both the gradation-information-bearing image layer and the character-information-bearing image layer.

D.1. Configuration of the transparent protective layer

A transparent protective layer meeting these requirements can be formed with the hot melt compound described in Japanese Patent O.P.I. Publication No. 183881/1988, line 9, lower left column, page 9 through line 15, upper left column, page 10 and the thermoplastic resin exemplified in the same publication, line 16, upper left column, page 10 through line 9, lower left column, page 11.

It is also effective to add a UV absorbent to the transparent protective layer in protecting the gradation-information-bearing image from ultraviolet rays during setting of the UV-setting prepolymer by UV irradiation of a coating agent containing it.

Examples of UV absorbents include the compounds exemplified in the description of the image-receiving layer.

Varying depending on the type of compound, the contents of these substances in the transparent protective layer can be determined experimentally for each compound.

The thickness of the transparent protective layer is normally 0.5 to 20.0 μm, preferably 1.0 to 10.0 μm in view of uniform coatability of UV-setting resin.

D.2. Transfer sheet for protective layer formation

To form a transparent protective layer on the gradation-information-bearing image, it is preferable to use a transfer sheet for protective layer formation.

The transfer sheet for protective layer formation can be configured with a peeling layer, a transparent protective layer, and an adhesive layer formed as necessary, all formed on the support in this order.

A preferred mode of the transfer sheet for the formation of transparent protective layer is such that a protective layer formation sheet portion, comprising the peeling layer and the transparent protective layer formed in this order, and a hot melt ink sheet portion, are separately formed on the support.

In this transfer sheet, the hot melt ink sheet permits formation of a character-information-bearing image on the image-receiving surface of the substrate while the protective layer formation sheet portion permits simultaneous formation of a transparent protective layer on the gradation-information-bearing image surface formed on the image-receiving layer of the substrate.

The hot melt ink sheet portion may be configured with the layer structure described in the paragraph "C.1. Hot melt ink sheet".

E. Setting protective layer

In the image-recording material of the present invention, a substantially transparent setting protective layer set by UV irradiation is formed on the entire surface of the substrate having a gradation-information-bearing image and a character-information-bearing image.

The setting protective layer can be formed by coating a coating agent containing a UV-setting resin on the substrate, followed by UV irradiation.

E.1. Coating agent

The coating agent can be formed with a composition whose major components are a UV-setting prepolymer and a polymerization initiator.

The UV-setting prepolymer includes prepolymers having two or more epoxy groups in their molecular structure. Examples of such prepolymers include alicyclic polyepoxides, polybasic acid polyglycidyl esters, polyhydric alcohol polyglycidyl ethers, polyoxyalkylene glycol polyglycidyl ethers, aromatic polyol polyglycidyl ethers, hydrogenated polyglycidyl ethers of aromatic polyol, urethane polyepoxy compounds and epoxidated polybutadienes. These prepolymers may be used singly or in combination.

The content of prepolymers having two or more epoxy groups in their molecular structure in the coating agent is preferably not less than 70% by weight.

The polymerization initiator is preferably a cationic polymerization initiator, specifically an aromatic onium salt.

Examples of such aromatic onium salts include phosphonium slats and other salts of elements in Group Va in the periodic table of elements such as triphenylphenacylphosphonium hexafluorophosphate, sulfonium salts and other salts of element in Group VIa such as triphenylsulfonium tetrafluoroborate, triphenylsulfonium hexafluorophosphate, tris(4-thiomethoxyphenyl)sulfonium hexafluorophosphate and triphenylsulfonium hexafluoroantimonate and iodonium salts and other salts of elements in Group VIIa such as diphenyliodonium chloride.

How to use these aromatic onium salts as cationic polymerization initiators for polymerization of epoxy compounds is described in detail in U.S. Pat. Nos. 4,058,401, 4,069,055, 4,101,513 and 4,161,478.

Preferable cationic polymerization initiators are sulfonium salts of elements in Group VIa, with more preference given to triaryl sulfonium hexafluoroantimonate from the viewpoint of UV settability and UV-setting composition storage stability.

The cationic polymerization initiator content in the coating agent is preferably 3 to 20% by weight, more preferably 5 to 12% by weight. Cationic polymerization initiator contents lower than 1% by weight of the coating agent are undesirable because they can extremely decrease the setting speed during UV irradiation.

In addition to the above-mentioned epoxy setting resins, radical polymerizable resins such as monofunctional or polyfunctional acrylate compounds are included in UV-setting resins.

The coating agent may contain surfactants such as oils, especially silicone oil, and silicone-alkylene oxide copolymers (e.g., L-5410, commercially supplied by Union Carbide), silicone oil containing aliphatic epoxides, and fluorocarbon surfactants such as FO-171 and FO-430, commercially supplied by 3M, and Megafac F-141, commercially supplied by Dainippon Ink and Chemicals Inc.

The coating agent may further contain vinyl monomers such as styrene, p-methylstyrene, methacrylates and acrylates, celluloses, and monoepoxides such as thermoplastic polyester, phenylglycidyl ether, silicon-containing monoepoxide and butylglycidyl ether, as long as the effect of the present invention is not interfered with.

The coating agent may contain inert components, including fillers such as talc, calcium carbonate, alumina, silica, mica, barium sulfate, magnesium carbonate and glass, dyes, pigments, thickening agents, plasticizers, stabilizers, leveling agents, coupling agents, tackifiers, wettability improvers such as silicone group containing activators and fluorocarbon group containing surfactants, and other various additives. The coating agent may also contain small amounts of solvents showing almost no reaction with the cationic polymerization initiator such as acetone, methyl ethyl ketone and methyl chloride for the purpose of improving the fluidity of the coating agent during its coating.

E.2. Coating method and conditions

Coating of the coating agent to the surface of the substrate can be achieved by coating the coating agent, as such or after being adjusted to appropriate viscosity by the addition of solvent etc. if necessary, on the surface of the substrate by ordinary coating means such as a double roll coater, slit coater, air knife coater, wire bar coater, slide hopper and spray coater.

By one of these coating methods, a coating layer with the coating agent is coated on the surface of the base to a thickness of normally 0.1 to 30 μm, preferably 1 to 14 μm.

After coating, the coating layer with the coating agent is irradiated with UV, whereby polymerization or setting reaction of the UV-setting prepolymer in the coating agent proceeds.

Here, "ultraviolet (UV)" means light in the UV band, including light beams involving light in the UV band. Consequently, UV irradiation includes solar ray irradiation, low voltage mercury lamp irradiation, high voltage mercury lamp irradiation, ultrahigh voltage mercury lamp irradiation, carbon arc irradiation, metal halide lamp irradiation and xenon lamp irradiation.

UV irradiation is preferably conducted in an inert gas atmosphere such as air, nitrogen gas or carbon dioxide gas.

Although UV irradiation time varies depending on the type of irradiation light source in the UV band, it is normally 0.5 second to 5 minutes, preferably 3 seconds to 2 minutes. When the irradiation time is short, a large light sources with high irradiation intensity is required; when the irradiation time is long, a small light source with low irradiation intensity can be used, though the use of a light source with low irradiation intensity requires long setting action time, which is unadvantageous from the viewpoint of process efficiency. In the present invention, however, a setting film with practically satisfactory strength can be formed by 3 seconds to 2 minutes of irradiation using a UV lamp with 200 W or lower output.

Setting time can be shortened by heating the film of the coating agent at, before or after UV irradiation. When such heating is conducted, heating temperature is preferably 30° to 80° C. Before UV irradiation, heating time at the heating temperature may be long or short, but after UV irradiation, heating time is preferably 1 to 120 minutes.

EXAMPLES

The present invention is hereinafter described in more detail by means of the following working examples and comparative examples. In the description below, part(s)" means "part(s) by weight".

Examples 1 through 6

(1) Formation of image-receiving layer

After coating an image-receiving layer coating liquid having one of the following compositions a, b and c on a 100 μm thick *White Pet* (W-400, produced by *Dia Foil K.K.*) using a wire bar, the coating was dried using a drier and heated in an oven at 120° C. to completely eliminate the solvent to yield a 5 μm thick image-receiving layer.

| | |
|---|---|
| Composition a: | |
| Vinyl chloride resin (TK-300, produced by Shin-Etsu Chemical Co., Ltd.) | 9.5 parts |
| Modified silicon resin (X-24-8300, produced by Shin-Etsu Chemical Co., Ltd.) | 0.5 parts |
| Methyl ethyl ketone | 72.0 parts |
| Cyclohexanone | 18.0 parts |
| Composition b: | |
| Vinyl chloride resin (*Leuron Q640*, produced by Tosoh Corporation) | 9.5 parts |
| Modified silicon resin (X-24-8300, produced by Shin-Etsu Chemical Co., Ltd.) | 0.5 part |
| Methyl ethyl ketone | 72.0 parts |
| Cyclohexanone | 18.0 parts |
| Composition c: | |
| Polyester resin (Vylon 290, produced by Toyobo Co., Ltd.) | 8.0 parts |
| Polyfunctional isocyanate compound (Coronate HX, produced by Nippon Polyurethane Industry) | 1.0 parts |
| Modified silicon resin (KF-393, produced by Shin-Etsu Chemical Co., Ltd.) | 0.5 part |
| Modified silicon resin (X-22-343, produced by Shin-Etsu Chemical Co., Ltd.) | 0.5 part |
| Methyl ethyl ketone | 72.0 parts |
| Cyclohexanone | 18.0 parts |

(2) Preparation of ink sheet for thermal transfer recording

On the corona-treated surface of a 6 μm thick polyethylene terephthalate film support was coated and dried an ink layer coating liquid with the following composition by the wire bar coating method to a dry thickness of 1 μm. On the back face, not subjected to corona treatment, one or two drops of silicone oil (X-41, 4003A, produced by Shin-Etsu Chemical Co., Ltd.) were dropped using a syringe and spread over the entire surface for a back face coating treatment to yield three kinds of ink sheets for thermal transfer recording with yellow, magenta and cyan colors, respectively.

| Ink layer coating liquid Dispersion Dyes | |
|---|---|
| a) Yellow: MS Yellow (produced by Mitsui Toatsu Chemicals Inc.) | 3 parts |
| b) Magenta: MS Magenta (produced by Mitsui Toatsu Chemicals Inc.) | 5 parts |
| a) Cyan: Kayaset Blue 136 (produced by Nippon Kayaku Co., Ltd.) | 4 parts |

Polyvinyl butyral (BX-1, produced by Sekisui Chemical Co., Ltd., Tg 85.5° C., acetal conversion degree 64 mol %, acetyl group content not more than 3 mol %) 5 parts for each

| | |
|---|---|
| Toluene | 40 parts for each |
| Methyl ethyl ketone | 40 parts for each |
| Dioxane | 10 parts for each |

(3) Formation of image

The image-receiving layer of the image-receiving sheet for thermal transfer recording prepared in (1) above and the ink layer of the ink sheet for thermal transfer recording prepared in (2) above were superposed and heated from the thermal transfer recording ink sheet side under conditions of 0.23 W/dot output, 0.3 to 4.5 msec pulse width and 16 dots/mm dot density using a thermal head to form a personal facial image with gradation on the image-receiving layer.

(4) Preparation and transfer of UV-absorbing resin transfer sheet

A UV-absorbing resin layer coating liquid having either of the following compositions a and b was coated on a 4.5 μm thick polyethylene terephthalate film (support) to yield a UV-absorbing resin transfer sheet having a 3 μm thick UV-absorbing resin layer.

| | |
|---|---|
| UV-absorbing resin layer coating liquid a: | |
| Polyester resin (Vylon 200, produced by Toyobo Co., Ltd.) | 6.0 parts |
| UV absorbent 2,4-dihydroxybenzophenone | 4.0 parts |
| Methyl ethyl ketone | 90.0 parts |
| UV-absorbing resin layer coating liquid b: | |
| Polyester resin (Vylon 200, produced by Toyobo Co., Ltd.) | 8.0 parts |
| UV absorbent 2,4-dihydroxybenzophenone | 2.0 parts |
| Methyl ethyl ketone | 90.0 parts |

Next, the image-receiving sheet for thermal transfer recording and the UV-absorbing resin transfer sheet were superposed so that the personal facial image obtained in (3) above was covered with the UV-absorbing resin layer. After heating at 120° C. from the back face of the UV-absorbing resin transfer sheet using a heat roller for 1 to 2 seconds, the support was peeled to transfer the UV-absorbing resin layer onto the image.

(5) Preparation, coating and UV-setting of UV-setting resin layer coating liquid Next, the following UV-setting resin layer coating liquid was coated on the surface of the image-receiving layer including the UV-absorbing resin layer to a coating amount of 10 g/m$^2$ by the wire bar method, followed by setting the UV-setting resin layer coating liquid under the following setting conditions to yield a UV-setting resin layer (setting protective layer).

| | |
|---|---|
| UV-setting resin layer coating liquid: | |
| Bis(3,4-epoxy-6-methylcyclohexylmethyl) adipate (ERL-4299, produced by UCC) | 70 parts |
| Bisphenol A glycidyl ether | 10 parts |
| 1,4-butanediol glycidyl ether | 13 parts |
| Triaryl sulfonium fluoroantimony | 7 parts |
| UV-setting conditions | |
| Light source: 60 W/cm$^2$ high voltage mercury lamp. | |
| Irradiation distance: 10 cm | |
| Irradiation mode: Light scanning at 3 cm/minute. | |

The thermal transfer image-recording materials obtained through the procedures (1) through (5) were subjected to a light fastness test, in which they were stored in a xenon weather meter for 72 hours and then macroscopically evaluated with respect to image discoloration and fading using the following criteria. The results are shown in Table 1.

A: Almost no change in hue.

B: Slight discoloration or fading, but not so severe that the commercial value is lost.

C: Considerable discoloration and fading.

For a solvent resistance test, recorded images were rubbed with methyl ethyl ketone soaked absorbent cotton to determine whether the image disappeared or not.

B: No change in image upon rubbing.

C: Upon rubbing, dyes dissolved in the solvent and the image disappeared.

Comparative Examples 1 through 3

Thermal transfer image-recording materials were prepared and evaluated in the same manner as in Examples 1, 3 and 5 except that the UV-absorbing resin layer coating liquid a or b was replaced with a coating liquid having the following composition c. The results are shown in Table 1.

| | |
|---|---|
| UV-absorbing resin layer coating liquid c: | |
| Polyester resin (Vylon 200, produced by Toyobo Co., Ltd.) | 10.0 parts |
| Methyl ethyl ketone | 90.0 parts |

Comparative Examples 4 through 6

Thermal transfer image-recording materials were prepared and evaluated in the same manner as in Examples 1, 3 and 5 except that the UV-absorbing resin layer was not formed. The results are shown in Table 1.

Comparative Examples 7 through 9

Thermal transfer image-recording materials were prepared and evaluated in the same manner as in Examples 1, 3 and 5 except that the UV-setting resin layer was not formed. The results are shown in Table 1.

TABLE 1

| | Image-receiving layer coating liquid | UV-absorbing resin layer coating liquid | Presence of UV-setting resin layer | Light fastness | Solvent resistance |
|---|---|---|---|---|---|
| Example 1 | a | a | Yes | A | B |
| Example 2 | a | b | Yes | A | B |
| Example 3 | b | a | Yes | A | B |
| Example 4 | b | b | Yes | B | B |
| Example 5 | c | a | Yes | B | B |
| Example 6 | c | b | Yes | B | B |
| Comparative Example 1 | a | c | Yes | C | B |
| Comparative Example 2 | b | c | Yes | C | B |
| Comparative Example 3 | c | c | Yes | C | B |
| Comparative Example 4 | a | No | Yes | C | B |
| Comparative Example 5 | b | No | Yes | C | B |
| Comparative Example 6 | c | No | Yes | C | B |
| Comparative Example 7 | a | a | No | A | C |
| Comparative Example 8 | b | a | No | A | C |
| Comparative Example 9 | c | a | No | A | C |

The thermal transfer image-recording material of the present invention exhibits excellent light fastness for long periods with no image discoloration or fading because the image formed on the image-receiving layer is covered with the UV-absorbing resin layer and UV-setting resin. In addition, it is durable against solvents etc. and thus offers excellent image preservability. It is also excellent in the prevention of image falsification. With these favorable features, the thermal transfer image-recording material of the present invention can be used as a high quality image source for identification photographs and other fields.

Preparation of cards according to the present invention are hereinafter described in detail by means of some examples. In the description below, "part(s)" means "part(s) by weight".

Example A1

(1) A card-sized image-receiving sheet was prepared as follows. A 150 μm thick hard transparent vinyl chloride sheet was hot melt adhered to both faces of a 450 μm thick hard white vinyl chloride sheet to yield a 750 μm thick wide white vinyl chloride sheet, which was then coated with an image-receiving layer coating liquid with the following composition by the wire bar method and dried to eliminate the solvent to yield a 4.0 μm thick image-receiving layer.

Composition of the image-receiving layer coating liquid

Vinyl chloride (TK-600, produced by Shin-Etsu Chemical Co., Ltd.) 9.9 parts

Solvent (methyl ethyl ketone/cyclohexanone=8/2) 90.0 parts

Silicon resin (mold releasing agent) (X24 8300, produced by Shin-Etsu Chemical Co., Ltd.) 0.1 part Next, on the support surface opposite to the image-receiving layer was coated and dried a writing layer coating liquid with the following composition to yield a 40 μm thick writing layer.

The wide image-receiving sheet thus obtained was cut into an image-receiving sheet with a card size of 54.0 mm×85.5 mm.

| Composition of the writing layer coating liquid | |
|---|---|
| Colloidal silica | 2.5 parts |
| Gelatin | 7.0 parts |
| Hardener (Formula A) | 0.5 part |
| Water | 90 parts |

Formula A

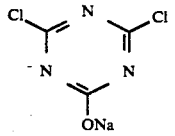

(2) An ink sheet for sublimation thermal transfer recording was produced as follows.

On the corona-treated surface of a 6 μm thick polyethylene terephthalate film support was coated and dried an ink layer coating liquid with the following composition by the wire bar coating method to a dry thickness of 1 μm so that the polyethylene terephthalate sheet was colored into yellow (Y), magenta (M) and cyan (C) colors in the longitudinal direction. On the back face, not subjected to corona treatment, one or two drops of silicone oil (X-41, 403A, produced by Shin-Etsu Silicone Co., Ltd.) were dropped using a syringe and spread over the entire surface for a back face coating treatment to yield three ink sheets for thermal transfer recording with Y, M and C colors, respectively.

| Yellow ink layer coating liquid | |
|---|---|
| Yellow dispersion dye: MS Yellow (produced by Mitsui Toatsu Senryo K.K.) | 3 parts |
| Polyvinyl butyral (BX-1, produced by Sekisui Chemical Co., Ltd., degree of polymerization 1700, Tg 85.5° C., acetal conversion degree 64 mol %, acetyl group content not more than 3 mol %) | 5 parts |
| Polyester-modified silicone (X-24-8310, produced by Shin-Etsu Chemical Co., Ltd.) | 0.4 part |
| Toluene | 40 parts |
| Methyl ethyl ketone | 40 parts |
| Dioxane | 10 parts |
| Magenta ink layer coating liquid | |
| Magenta dispersion dye: MS Magenta (produced by Mitsui Toatsu Senryo K.K.) | 5 parts |
| Polyvinyl butyral (BX-1, produced by Sekisui Chemical Co., Ltd., degree of polymerization 1700, Tg 85.5° C., acetal conversion degree 64 mol %, acetyl group content not more than 3 mol %) | 5 parts |
| Polyester-modified silicone (X-24-8310, produced by Shin-Etsu Chemical Co., Ltd.) | 0.4 part |
| Toluene | 40 parts |
| Methyl ethyl ketone | 40 parts |
| Dioxane | 10 parts |
| Cyan ink layer coating liquid | |
| Cyan dispersion dye: Kayaset Blue 136 (produced by Nippon Kayaku Co., Ltd.) | 4 parts |
| Polyvinyl butyral (BX-1, produced by Sekisui Chemical Co., Ltd., degree of polymerization 1700, Tg 85.5° C., acetal conversion degree 64 mol %, acetyl group content not more than 3 mol %) | 5 parts |
| Polyester-modified silicone (X-24-8310, produced by Shin-Etsu Chemical Co., Ltd.) | 0.4 part |
| Toluene | 40 parts |
| Methyl ethyl ketone | 40 parts |
| Dioxane | 10 parts |

(3) A sheet having a hot melt ink layer and a transparent protective layer was produced as follows. A hot melt ink layer coating liquid was coated by the wire bar method and dried on one side of the surface of a 4.5 μm thick polyethylene terephthalate sheet to yield a 1.2 μm thick hot melt layer. Also, a transparent protective layer coating liquid having the following composition was coated by the wire bar method and dried on the non-coated portion of the surface of the sheet on which the hot melt ink layer was formed as above to yield a 3.0 μm thick transparent protective layer.

A hot melt ink layer and a transparent protective layer were thus separately formed on one face of the polyethylene terephthalate sheet. On the face opposite to the hot melt ink layer of the polyethylene terephthalate sheet was coated an anti-sticking layer coating liquid having the following composition to yield a 0.6 μm thick anti-sticking layer.

| Composition of the hot melt ink layer coating liquid | |
|---|---|
| Carnauba wax | 1 part |
| Ethylene-vinyl acetate copolymer (EV 40Y, produced by Du-Pont Mitsui Chemical Co., Ltd.) | 1 part |
| Carbon black | 6 parts |
| Phenol resin (Tamanol 521, produced by Arakawa Chemical Industry Ltd.) | 12 parts |
| Methyl ethyl ketone | 80 parts |
| Composition of the transparent protective layer coating liquid | |
| Polyester resin (Vylon 200, produced by Toyobo Co., Ltd.) | 6.5 parts |
| UV absorbent 2,4-dihydrooxybenzophenone | 3.5 parts |
| Methyl ethyl ketone (solvent) | 90 parts |
| Anti-sticking layer coating liquid | |
| Nitrocellulose | 3 parts |
| Acryl silicon resin | 7 parts |
| Methyl ethyl ketone | 90 parts |

(4) Preparation of UV-setting resin containing coating liquid

A UV-setting resin containing coating liquid with the following composition was prepared.

| UV-setting resin containing coating liquid | |
|---|---|
| Bis(3,4-epoxy-6-methylcyclohexylmethyl) adipate (ERL-4299, produced by UCC) | 70 parts |
| Bisphenol A glycidyl ether | 10 parts |
| 1,4-butanediol glycidyl ether | 13 parts |
| Triaryl sulfonium fluoroantimony | 7 parts |

(5) An image-recording material was produced as follows. The image-receiving layer of the image-receiving sheet and the sublimation dye containing layer of the ink sheet for sublimation thermal transfer recording were superposed and heated from the sublimation thermal transfer recording ink sheet side under conditions of 0.23 W/dot output, 0.3 to 4.5 msec pulse width and 16 dots/mm dot density using a thermal head to form a personal facial image with gradation.

Next, after transferring the transparent protective layer onto the image-receiving layer of the image-receiving sheet with the transfer area was slightly larger than the personal facial image so that the transparent protective layer completely covered the surface of the personal facial image formed on the image-receiving layer of the image-receiving sheet as follows, the hot melt ink layer was superposed thereon and heated under conditions of 0.5 W/dot output, 1.0 msec pulse width and 16 dots/mm dot density using a thermal head to transfer the character information. The transparent protective layer was heated at 120° C. using a heat roller for 1.2 seconds, after which the support was peeled off, whereby it was easily transferred onto the image-receiving layer.

The UV-setting resin containing coating liquid was coated on the surface of the image-receiving layer bearing the character information image and personal facial image to a coating amount of 10 g/m$^2$, followed by setting of the UV-setting resin containing coating liquid under the following setting conditions to yield a setting protective layer.

UV-setting conditions

Light source: 60 W/cm$^2$ high voltage mercury lamp.
Irradiation distance: 10 cm
Irradiation mode: Light scanning at 3 cm/minute.

The image-recording material thus obtained is designated as Example A1.

(6) The following evaluation was made.

1) Appearance: The samples were compared with respect to appearance and commercial value.
2) Prevention of forgery and alteration
   i) The surface protective layer on the image-receiving layer was peeled at 80° C. and observed for the peeling state.
   ii) Falsifiability of data written on the image-receiving layer
3) Durability: Determined by rubbing the sample surface with a pencil with a hardness H.

The results are shown in Table 1.

Comparative Examples 10 through 13

Samples were prepared in the same manner as in Example A1 except that the UV-setting resin protective layer alone was not formed to yield a sample of Comparative Example 10, the transparent protective layer alone was not formed to yield a sample of Comparative Example 11 and none of them was formed to yield a sample of Comparative Example 12.

Also, the sample of Comparative Example 12 was thermally fused with a commercially available pouch film (produced by Nippon GBC, 100 μm) using a simple laminator (LPC 170, produced by Fuji Plastic Kikai K.K.) at 140° C. to yield a sample of Comparative Example 13.

These four samples were compared as to performance for the same items as in Example A1. The results are shown in Table A1.

From these results, it is evident that the samples in Comparative Examples all had a critical failure for the use as ID card, while the sample of Example A1 makes it possible to provide ID cards excellent in all of appearance, prevention of forgery and alteration and durability.

TABLE A1

| | Appearance | Prevention of forgery and alteration | Durability |
|---|---|---|---|
| Example A1 | Beautiful | 1) Substrate destroyed<br>2) Impossible | No flaw |
| Comparative Example 10 | Beautiful | 1) Transparent protective layer destroyed<br>2) Very easy | Character image difficult to read out. |
| Comparative Example 11 | Dye blur and UV fading in the photographic image are considerable during coating the UV-setting resin | 1) Substrate destroyed<br>2) Impossible | No flaw |
| Comparative Example 12 | Gloss is less than Ex. A1 | 1) Substrate destroyed<br>2) Very easy | Character, image easily damaged |
| Comparative Example 13 | Less surface gloss than Example 1<br>Gloss is less than Ex. A1 Image slightly blurred | 1) Easily detachable from the adhesion interface<br>2) Falsifiable | Surface scratches |

Examples A2 through A5 and Comparative Examples 14 through 17.

Next, the amount of mold releasing agent added to the image-receiving layer in Example 1 was changed as shown in Table 2, and the UV-setting resin coatability was determined and the peeling status of the surface protective layer on the image-receiving layer at 80° C. was observed.

Samples were prepared in the same manner as in Examples 2 through 5 except that the transparent protective layer and UV-setting resin layer were replaced with the pouch film used in Comparative Example 4 as the surface protective layer to yield samples of Comparative Examples 14 through 17, respectively.

The evaluation criteria in Table A2 are as follows.

A: very good.

B: Good.

C: Slight uneven coating occurred, though commercial value was retained.

TABLE A2

| | Amount of mold releasing agent added | Coatability | Adhesion |
|---|---|---|---|
| Example A2 | 0.5 part by weight | A | A |
| Example A3 | 1.0 | A | A |
| Example A4 | 2.0 | B | B |
| Example A5 | 2.5 | C | B |
| Comparative example 14 | 0.5 part by weight | Interfacial peeling | |
| Comparative example 15 | 1.0 | Interfacial peeling occurred even at normal temperature | |
| Comparative example 16 | 2.0 | Interfacial peeling occurred even at normal temperature | |
| Comparative example 17 | 2.5 | Interfacial peeling occurred even at normal temperature | |

Examples A6 through A9

Samples were prepared in the same manner as in Example 1 except that the transparent protective layer was prepared in two layers as shown below, and that the UV absorbent was replaced with 2-hydroxybensophene, which was added in the amounts shown in Table 3 to the lower layer (layer on the image-receiving layer side) to yield samples of Examples A6 through A9. The images in Examples A6 through A9 and the images in Comparative Examples 12 and 13 were compared as to light fastness. The light fastness of the images was determined and evaluated as follows.

Light fastness: After exposure in a xenon weather meter for 72 hours, reflection density reduction in the maximum cyan density portion in the dye image was determined using PDA65, produced by Konica Corporation.

| Transparent protective layer | |
|---|---|
| Upper layer composition | |
| Polyparabanic acid (XT 4, produced by Tonen Sekiyu kagaku K.K.) | 9.5 parts |
| Silicon resin powder (Tospearl 108, Toshiba Silicone Co., Ltd.) | 0.5 part |
| 1,4-dioxane | 90 parts |
| Upper layer thickness | 0.2 μm |
| Lower layer composition | |
| Coating liquid with the same weight ratio as in Example 1 except for the UV absorbent. | |
| Lower layer thickness | 2.0 μm |

TABLE A3

| | Amount of UV absorbent added (part by weight) | Density reduction |
|---|---|---|
| Example A6 | 0.0 | −0.10 |
| Example A7 | 0.7 | 0.05 |
| Example A8 | 2.2 | −0.03 |
| Example A9 | 6.5 | 0.02 |
| Comparative example 12 | — | −0.17 |
| Comparative example 13 | — | −0.14 |

According to the method of the present invention:

(1) a card-sized image-recording material can be produced rapidly, (2) laminate film cutting dust does not occur during production of the image-recording material because no film is laminated on the image formation surface, (3) since a transparent protective layer is formed on the surface of the sublimation dye image, even when a coating liquid containing a UV-setting resin is coated and set by UV radiation, the sublimation dye image is not affected at all; therefore, a distinct gradation image can be formed with no damage in the production process, and (4) since the setting protective layer, formed with UV-setting resin, and the image-receiving layer have been adhesively unified unseparatable, neither the gradation image nor character information image is forgeable or alterable; therefore, an image recording material with high reliability for the information borne by the image and with high image durability.

What is claimed is:

1. A thermal transfer image recording material comprising:

a support having thereon, an image-receiving layer having a transferred image therein, a transparent protective layer and a UV set resin layer in this order.

2. The material of claim 1, wherein the support is a card size substrate which has provided thereon the image-receiving layer comprising:

(a) a transferred gradation-information-bearing image with a sublimation dye;

(b) a transferred character-information-bearing image by a hot melt thermal transfer method or with the sublimation dye;

wherein a part of the image-receiving layer having the transferred gradation-information-bearing image formed with the sublimation dye is covered with said transparent protective layer; and an entire surface of the card size substrate coated with the UV set resin.

3. The material of claim 2, wherein said transparent layer contains a UV absorbent in an amount sufficient to protect the gradation-information-bearing image from ultraviolet rays during setting of the UV-set resin.

4. The material of claim 1, wherein a thickness of the image-receiving layer is 1 to 50 μm.

5. The material of claim 4, wherein the thickness is 2 to 30 μm.

6. The material of claim 1, wherein said transparent layer contains a UV absorbent in an amount sufficient to protect the gradation-information bearing image from ultraviolet rays during setting of the UV-set resin.

* * * * *